US005653558A

United States Patent [19]

Price

[11] Patent Number: 5,653,558

[45] Date of Patent: Aug. 5, 1997

[54] RETAINING WALL BLOCK

[75] Inventor: Raymond R. Price, Rochester, Minn.

[73] Assignee: Rockwood Retaining Walls, Inc., Rochester, Minn.

[21] Appl. No.: 578,359

[22] Filed: Dec. 26, 1995

Related U.S. Application Data

[63] Continuation-in-part of Ser. No. 158,463, Nov. 29, 1993.

[51] Int. Cl.[6] ..... E02D 29/00

[52] U.S. Cl. ..... 405/284; 52/608; 52/611; 405/258; 405/286

[58] Field of Search ..... 405/284, 286, 405/262, 258; 52/603, 604, 608, 610, 611

[56] References Cited

U.S. PATENT DOCUMENTS

| | | | |
|---|---|---|---|
| 3,995,434 | 12/1976 | Kato et al. | 52/611 X |
| 4,123,881 | 11/1978 | Muse | 52/611 X |
| 4,565,043 | 1/1986 | Mazzarese | 52/603 X |
| 4,964,761 | 10/1990 | Rossi | 405/284 X |
| 5,161,918 | 11/1992 | Hodel | 405/284 X |
| 5,337,527 | 8/1994 | Wagenaar | 405/284 X |
| 5,353,569 | 10/1994 | Rodrique | 52/608 X |
| 5,425,600 | 6/1995 | Gordon | 405/284 |
| 5,490,363 | 2/1996 | Woolford | 405/286 X |

*Primary Examiner*—Dennis L. Taylor
*Attorney, Agent, or Firm*—William J. Ryan

[57] ABSTRACT

A retaining wall block is provided which comprises a forward, face portion and a tail portion spaced rearwardly of said face portion and extending generally parallel thereto, said face portion and said tail portion being connected by a central web. A downwardly depending abutment member is formed on the bottom of said face portion to serve as a spacing mechanism for offsetting successive courses of block, thereby imparting a uniform backslope to the retaining wall. The block is designed in such a fashion that portions of the spacing mechanism may be easily removed or modified so as to permit different angles of backslope.

1 Claim, 3 Drawing Sheets

RETAINING WALL BLOCK

This is a continuation in-part application of my co-pending application Ser. No. 08/158,463, filed on Nov. 29, 1993.

SUMMARY OF THE INVENTION

The present invention relates to a block used in the construction of retaining walls in landscaping applications. Such walls are used to provide lateral support between differing ground levels where the change in one elevation to the other occurs over a relatively short distance.

Such retaining walls have been in existence for many years and have taken a variety of forms. Some have been constructed of wood timbers, others of rock in a natural form (such as limestone). Still others have been constructed of manufactured aggregate or concrete blocks. The present invention relates to a manufactured block.

When constructing a retaining wall, a number of design features must be considered. Generally, the wall will have to be backsloped toward the higher level to provide the wall with sufficient strength. This requires careful attention to the spacing of successive block courses so that the proper backslope is imparted to the wall. In addition, the wall must be anchored in a manner that will prevent blowouts and the like. The configuration of the wall must also be considered so that curves and corners can be constructed. In the prior art blocks, this last consideration has often necessitated the use of differently shaped or sized blocks to be used at curves or corners, depending on whether they are concave or convex. The present invention is designed to eliminate or minimize the various problems associated with each of these design considerations.

It is one object of the present invention to provide for a retaining wall block that is rearwardly horizontally "self-spacing" with respect to the blocks of the next lower course upon which the block is placed and supported, so as to thereby ensure a properly angled, uniform backslope along the wall.

It is another object of the present invention to provide for a retaining wall block that is "self-spacing" with respect to the blocks of the next lower course upon which the block is placed and supported, so as to thereby ensure a properly angled, uniform backslope along the wall, wherein the angle of the backslope may be varied according to the circumstances in which the wall is constructed.

It is another object of the present invention to provide for a retaining wall block that provides for a "self-locking" mechanism between various courses of the wall.

It is another object of the present invention to provide for a retaining wall block that is "self-anchoring" upon the backfilling of the area behind the wall.

It is yet another object of the present invention to provide for a retaining wall block that can be used in any area of the wall, including straight portions, curves or corners.

It is a further object of the present invention to provide for a retaining wall block that can be quickly and easily modified so as to be useful in walls having tightly curved or right angle corners.

To these ends, a retaining wall block is provided that comprises a first, forward face portion including a face surface, a second, rearward tail portion generally parallel to and spaced rearwardly of the face portion, and a central web portion connecting the face portion to the tail portion. The face portions are wider than the tail portions and designed to be laid in such a fashion that the ends of each face portion abut an end of each of the face portions of the next adjacent blocks. The face portions have a forward facing outer face surface and a rearward facing inner surface. A downwardly projecting abutment member is formed on the underside of each face portion and acts as a spacer when the block is supported (in a staggered fashion) upon a lower course of blocks by virtue of the fact that the abutment member is placed in abutting relation to the inner surfaces of the face portions of the blocks of the lower course. When the area behind a course of blocks is backfilled, it will be seen that the dirt will fill the areas between the face portion and the tail portion of adjacent blocks and the tail portion will thereby act as an anchor resisting lateral force upon the wall.

The abutment member may be scored or notched parallel to its forward surface in one or more places such that the width of the abutment member may be easily altered or varied by removing a portion of the abutment member with a hammer and chisel. Similarly, the top of the outer ends of the face portion may also be scored or notched parallel to the inner surface such that a portion of the inside of the face portion against which the abutment member of the block in the next above course abuts may be easily removed with a hammer and chisel.

Lastly, the face portion is notched to allow portions thereof to be easily removed with a hammer and chisel to modify the shape of the block for use in tight curves or right angle corners.

DETAILED DESCRIPTION OF THE PREFERRED EMBODIMENT

Figure 3:
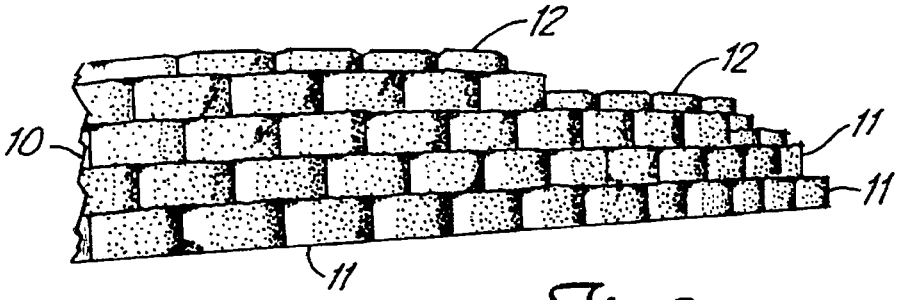
FIG. 3 is a front elevational view of a retaining wall constructed with blocks embodying the present invention.

Referring first to FIG. 3, there is shown a retaining wall 10 consisting of a number of courses of blocks 11 extending from just below the surface of a lower level (not illustrated) to just above the surface of an upper level (not shown). The top of the last course of blocks 11 in any given portion of the wall 10 is capped with a plurality of caps 12 which do not form a basis or a part of the present invention.

Each course of blocks 11 comprises a plurality of blocks 11 arranged side to side in the conventional fashion to present a continuous forward surface extending generally horizontally. Except for the lower course, which is laid upon a prepared base slightly beneath the surface of the lower level, each course is laid upon the preceding course in the manner hereafter described, with each block 11 in the higher course being staggered with respect to the blocks 11 upon which it rests in the lower course in the manner shown.

Figure 1:
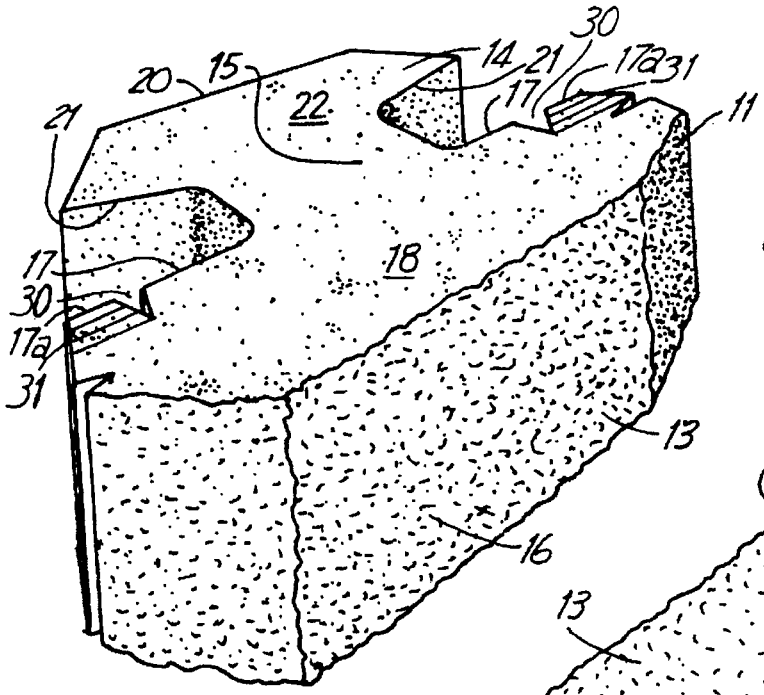
FIG. 1 is a front elevational perspective view of the top of a block according to the present invention.
Figure 2:
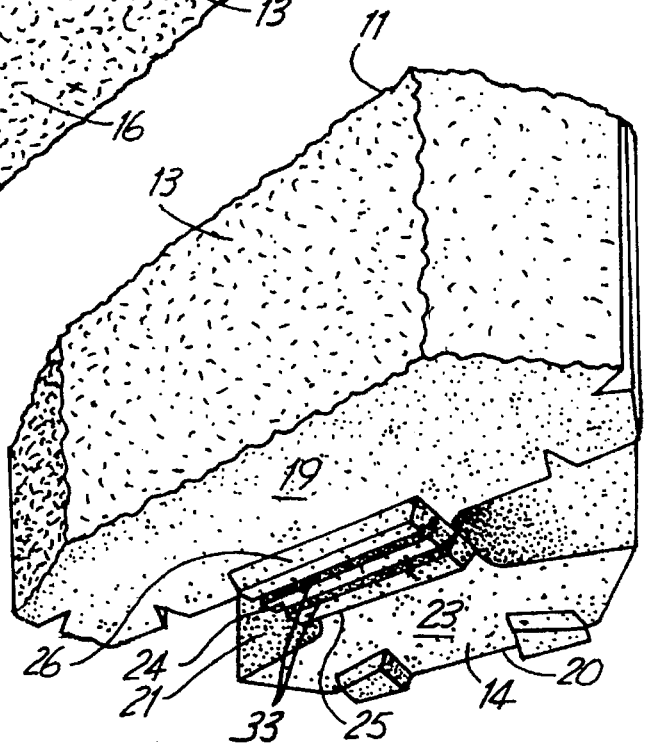
FIG. 2 is a front elevational perspective view of the bottom of a block according to the present invention.

FIGS. 1 and 2 illustrate the composition of each block 11. The blocks 11 are advantageously formed of a poured aggregate material such as concrete to define a unitary piece. Each block 11 comprises a forward face portion 13, a tail portion 14, and a central web portion 15 extending between the face portion 13 and the tail portion 14. Thus, it will be seen that the block 11 has somewhat of an "H" shaped configuration except that the width of the face portion 13 is greater than that of the tail portion 14.

The face portion 13 comprises a forward, face surface 16, a rearward inner surface 17, a top surface 18 and a bottom surface 19. Similarly, the tail portion 14 comprises a rear surface 20 and a forward inner surface 21, a top surface 22 and a bottom surface 23. The web portion 15 extends between the spaced, inner surfaces 17, 21.

A downwardly depending abutment member 24 is formed on the bottom surface 19 of the face portion 13 at a point where the web portion 15 joins a face portion 13. The abutment member 24 has a rear surface 25 and a front surface 26 generally parallel to and spaced approximately one inch forwardly of the plane of the inner surface 17. The abutment member 24 serves as a spacing mechanism in the manner which is hereafter described.

To construct a retaining wall 10, a first course of blocks 11 is laid in a prepared, leveled area slightly below the lower level. In each course, including the first, the blocks 11 are laid in such a fashion that the ends of the face portions 13 of each block 11 abut one side of the face portions 13 of the next adjacent block 11. When a course has been laid, dirt is backfilled behind the blocks 11 into the space between the inner surfaces 17, 21 of face portions 13 and tail portions 14. Thus, it will be seen that the accumulation of backfill stabilizes the wall 10 and the tail portions 14 act to anchor the wall 10.

Figure 4:
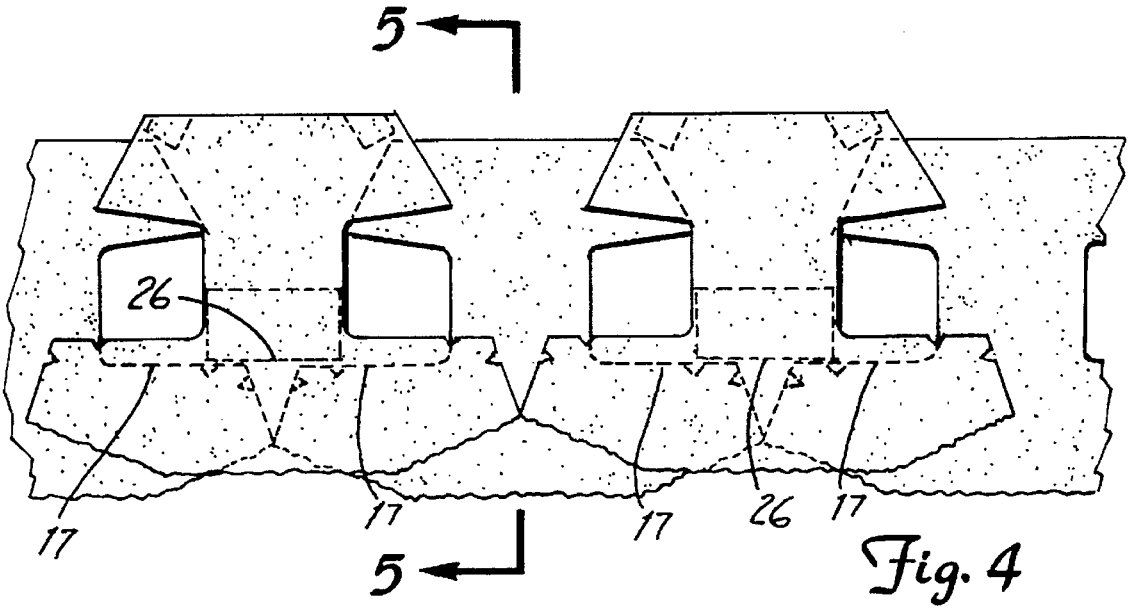
FIG. 4 is a top plan view of a portion of a wall constructed with blocks embodying the present invention showing obscured portions of the blocks in dashed line.
Figure 5:
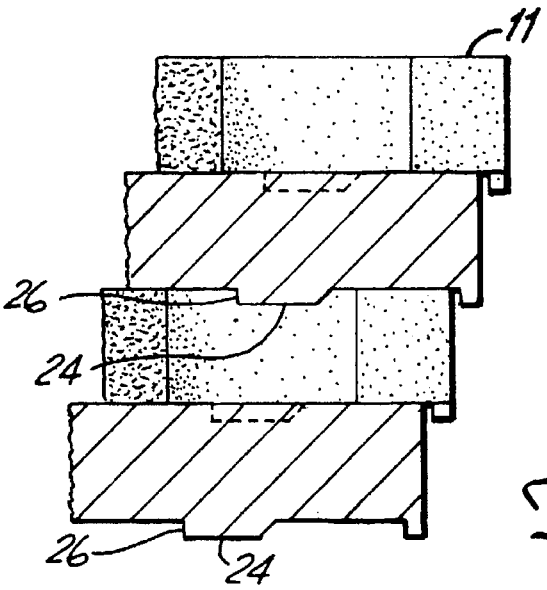
FIG. 5 is a side sectional view of a portion of a wall constructed with blocks embodying the present invention taken generally along the line 5—5 of FIG. 4.

The next course is laid upon the previous course in staggered fashion as best seen in FIGS. 3 and 4. The center of each block 11 is placed over the abutting ends of two blocks 11 in the lower course. This not only adds to the wall 10 aesthetically, but also stabilizes the wall 10 against lateral movement. When placing a block 11, the abutment member 24 is placed in abutment against the outer ends of the inner surfaces 17 of the two blocks 11 immediately below. This ensures a uniform horizontal offset between courses equal to the extent to which the front surface 26 of abutment member 24 is spaced forwardly of inner surface 17. As is discussed in more detail below, the amount of horizontal offset between blocks 11 of successive courses (and thus the angle of backslope in the wall) may be varied by removing a portion of the abutment member 24 or by removing a portion 17*a* of the outer ends of the inner surfaces 17 against which an abutment member 24 of the next above course abuts.

The face surface 16 of the blocks 11 are tapered rearwardly at their outer ends as seen in FIGS. 1 and 2. This facilitates the orientation of successive blocks 11 at oblique angles to one another as in the case of a concave curve in the wall 10. Similarly, to facilitate the orientation of successive blocks 11 at oblique angles to one another as in the case of a convex curve in the wall 10, the tail portions 14 are narrower in width than the face portions 13 and taper forwardly at their ends.

The block 11 incorporates a number of features that make it easily modified to change the angle of backslope in a wall or to accommodate tightly curved or even right angle corners in the wall. Vertical V-shaped notches 30 are formed in the inner surface 17 of face portion 13. The notches 30 extend along the entire height of the face portion 13 and are positioned with respect to the outer ends of inner surface 17 such that the portion (designated 17*a*) of inner surface 17 against which an abutment member 24 will abut when the wall 10 is constructed, is outside of each notch 30. The top surface 18 of face portion 13 has one or more scores or notches 31 running generally parallel to surface 17 at a depth of slightly more than the depth of abutment member 24. Selected portions of the face portion 13 between the scores or notches 31 can be easily removed with a chisel and hammer. Removal of such a portion will have the effect of advancing abutment portion 17*a* of inner surface 17 closer to face surface 16 thereby lessening the horizontal offset spacing between blocks 11 in successive courses and, consequently, the amount of backslope in the wall 10.

The amount of backslope may similarly be altered by removing a portion of abutment member 24. Abutment member 24 may also have one or more scores or notches 33 running essentially parallel to front surface 26. One or more portions of the abutment member 24 may be easily removed by a chisel and hammer to alter the width of the abutment member 24. It will be evident that changing the width of the abutment member 24 in this fashion will also change the amount of horizontal offset spacing between successive courses and, consequently, the backslope of the wall 10.

Figure 7:
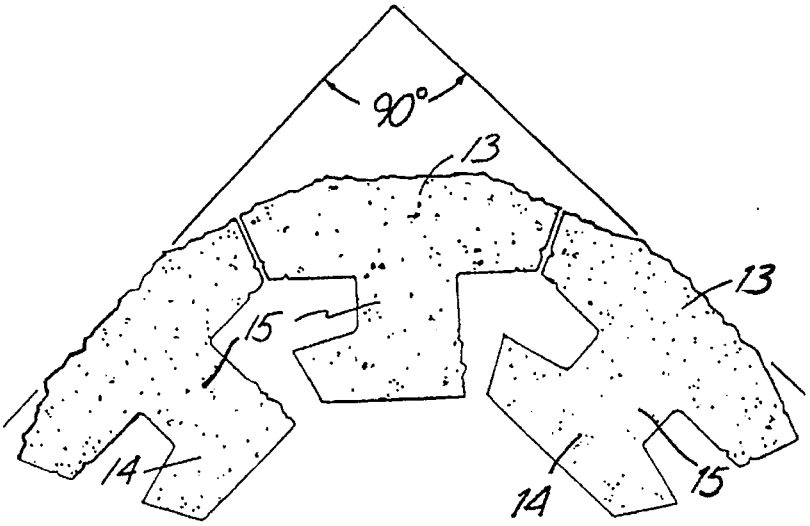
FIG. 7 is a top view of retaining wall blocks according to the present invention wherein a portion of the tail portion has been removed to form a tightly curved portion of wall.

A modification of a block 11 for use on tightly curved wall segments is best seen in FIG. 7. In order to accommodate the short radius of curvature, a side of the tail portion 14 may be easily removed by placing a chisel on top surface 22 in extension of one side of web portion 15 and striking it with a hammer.

Figure 6:
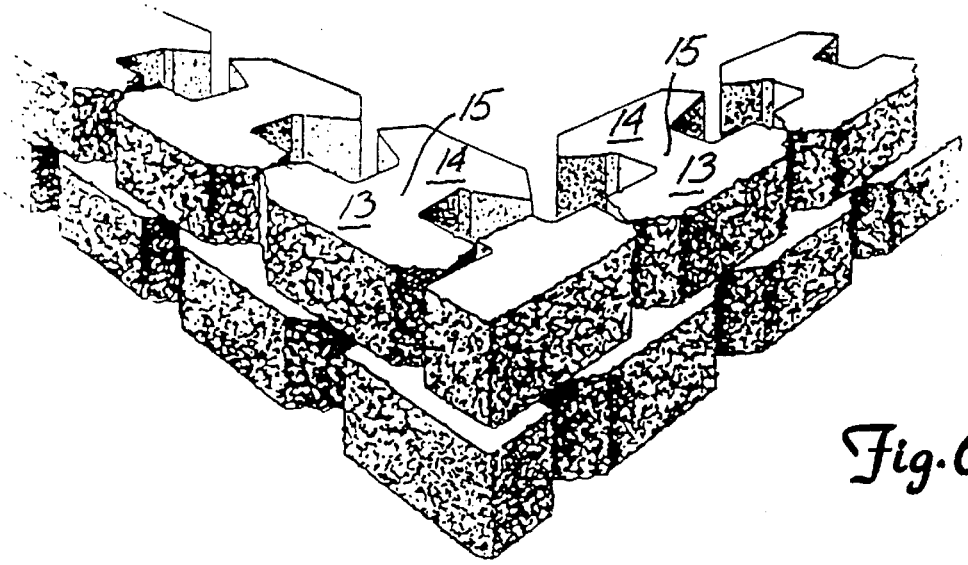
FIG. 6 is a top plan view of a retaining wall having a right angle corner wherein blocks according to the present invention have been modified for use at the corner.
Figure 8:
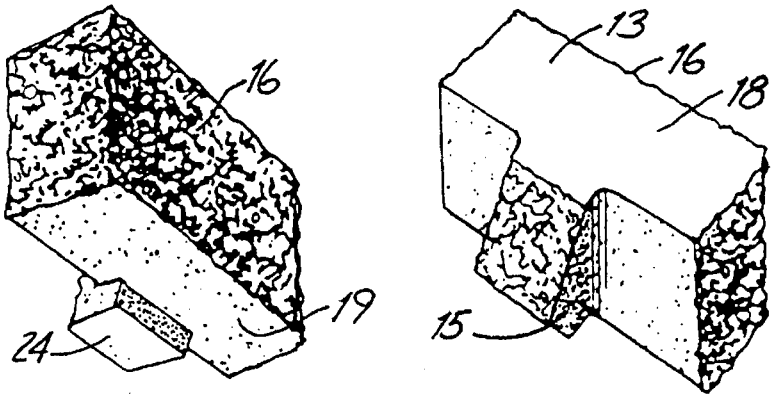
FIG. 8 is a top and bottom plan view of a corner block modified for use as shown in FIG. 6.

Another modification of a block 11 for use on right angle wall corners is shown in FIGS. 6 through 8. The face portion 13 is squared to remove the tapered outer ends by placing a chisel on top surface 18 in alignment with notch 30 and striking it with a hammer. Web portion 15 is then broken away by a chisel and hammer in such a fashion that abutment member 24 remains attached to face portion 13. This will leave a corner block 11 consisting of a rectangular face portion 13 and an abutment member 24. Because of the staggering of blocks 11 in successive courses, the orientation of the corner block 11 will also be staggered, thereby adding strength to the corner.

While I have described the preferred embodiment of my invention, it will be apparent to persons of ordinary skill in the art that other embodiments are possible within the scope of the invention.

What is claimed is:

1. A block for use in retaining walls wherein one course of blocks is laid upon a lower course of blocks, comprising:

(a) a face portion having an outer face surface, an inner face surface, a top surface, and a bottom surface;

(b) a tail portion spaced from said face portion extending generally parallel thereto, said tail portion being narrower in width than said face portion;

(c) a central web portion connecting said face portion to said tail portion so as to define a space on each side of said web portion between said inner surface of said face portion and said tail portion;

(d) a downwardly depending abutment member formed on the bottom surface of said face portion and spaced rearwardly of said face surface of said face portion, said abutment member defining one or more notches formed therein, said notches extending generally parallel to said face surface of said face portion; and (e) a pair of generally vertical notches defined in said inner face surface of said face portion, one of said notches being positioned on each side of said web portion, and said top surface of said face portion defining one or more scores extending outwardly of each of said notches and generally parallel to said inner surface of said face portion.

* * * * *